United States Patent [19]

Cohen

[11] Patent Number: 4,552,478

[45] Date of Patent: Nov. 12, 1985

[54] RING MECHANISM

[75] Inventor: Lewis Cohen, Toronto, Canada

[73] Assignee: Double-W Stationery Corporation, Weston, Canada

[21] Appl. No.: 630,138

[22] Filed: Jul. 12, 1984

[51] Int. Cl.[4] ..... B42F 3/04; B42F 13/26

[52] U.S. Cl. ..... 402/39; 402/31

[58] Field of Search ..... 402/31, 32, 33, 34, 402/35, 36, 37, 38, 39, 40, 41

[56] References Cited

U.S. PATENT DOCUMENTS

| | | | |
|---|---|---|---|
| 1,840,743 | 1/1932 | Schade | 402/39 |
| 1,915,140 | 6/1933 | Watson | 402/39 |
| 2,265,822 | 12/1941 | Spalding | 402/34 |
| 2,512,415 | 6/1950 | Buenger et al. | 402/37 |
| 3,263,687 | 8/1966 | Weichert | 402/39 |
| 3,809,485 | 5/1974 | Beyer | 402/31 |
| 4,214,839 | 7/1980 | Sheehan et al. | 402/31 |

FOREIGN PATENT DOCUMENTS

| | | | |
|---|---|---|---|
| 181288 | 11/1962 | Sweden | 402/36 |
| 410858 | 10/1966 | Switzerland | 402/31 |
| 1190176 | 4/1970 | United Kingdom | 402/39 |

*Primary Examiner*—Paul A. Bell

*Attorney, Agent, or Firm*—Rogers, Bereskin & Parr

[57] ABSTRACT

A ring mechanism for mounting on a loose leaf binder has ring elements, for retaining paper, secured to carrier rails within a cover rail. The ring elements are moveable between open and closed positions. The ring elements include bottom portions extending to intermediate locations higher than their lower ends, but arranged to support paper below the top of the cover rail. Additionally, the ring elements are mounted so their first ends are spaced above the binder cover. This arrangement provides operating space for the ring elements, while enabling the ring elements to have a large capacity.

26 Claims, 8 Drawing Figures

RING MECHANISM

This invention relates to a ring mechanism for loose leaf binders and the like.

There are a variety of known ring mechanisms common to these mechanisms is the provision of elements forming the ring, which elements extends outwardly from carrier rails. The carrier rails are located within a cover rail, and the ring elements extend through apertures in the cover rail. In most known mechanisms, the ring elements extend outwardly from the cover rails such that, in a closed position, the ring elements form a generally circular closure. Owing to the manner in which the ring elements are attached to the carrier rails through the cover rail, sheets of paper on the ring elements cannot lie against the binder cover. The paper has to lie against the top of the cover rail, instead of against a cover. The body of the cover rail is of substantial height. This impairs the storage capacity by an amount at least equal to the height of the cover rail. In such a mechanism, paper can be trapped below the bottom portions of the ring elements, so that it will not readily pass over the ring elements to the other side of the ring, when the binder is closed. To close the binder, several small batches of paper have to be moved over individually by hand. This is tedious and inconvenient. If this step is omitted, and the binder is simply closed, then the paper in it can be torn or damaged.

Various proposals have been made for modifications to this basic ring binder method, but these proposals all suffer from a variety of disadvantages. These proposals are discussed below.

U.S. Pat. No. 1,915,140 (Watson) is an old disclosure that shows a loose leaf binder mechanism. Here, the patent is exclusively concerned with a novel shell or base member, and is particularly concerned with a shell member including novel inturned edges, to enable it to be used in different configurations. The actual form and operation of the ring elements is not discussed. However, it does show ring elements, which extend on both sides of the shell or base member almost exactly vertically and parallel to one another. The upper ends of the ring elements are formed as quadrants, so as to form a semi-circle in the closed position. The ring elements thus eminate from the top, rather than from the sides, of the shell or cover rail. This has the disadvantage that paper retained on the ring elements, must be spaced from the binder cover by an allowance equal to the thickness of the shell or cover rail, and indeed this is clearly shown in the drawings of this patent.

U.S. Pat. No. 2,512,415 (Buenger et al) discloses a loose leaf binder. It is solely concerned with a spacer adapted to simplify the assembly of the ring metal with the case. For this purpose, special spaces are provided, which limit movement of the ring or carrier plates. Again, this patent is not directly concerned with the shape or function of the ring elements, and discloses ring elements that effectively form a circular ring. The provision of the special spacers causes the cover rail and the ring elements to be spaced some way above the spine of the binder, so that paper must necessarily be spaced some distance from the spine.

British Pat. No. 954,417 (Speykers) is concerned with a mounting of a loose-leaf binder mechanism on the actual binder. To this end, it provides a construction for the mounting plate or cover rail, which enables it to be secured at three separate locations by only one size of rivet. It refers to curved prongs, for the paper. However, the drawings show prongs or ring elements for the paper, which have straight, vertical and parallel sides. The form and purpose of the ring elements or prongs is again not discussed. However, the ring elements extend from the top of the cover rail, so that again paper must be spaced by at least the thickness of the cover rail from the binder. Also, lower ends of the ring elements extend at an angle upwards and outwards from the cover rail, which it is expected would only serve to trap the paper beneath them and operation of the mechanism more difficult.

British Pat. No. 190,176 (Krause KG) and U.S. Pat. No. 3,263,687 (Weichert) both disclose mechanisms with many similarities. They are concerned with different ways of attaching one ring element of each pair to its carrier rail, but the overall external form of the two mechanisms disclosed in these two patents is the same. Weichert describes a ring mechanism for overcoming the difficulties of known mechanisms in which the paper is necessarily spaced from the cover of the binder. One of the ring elements is attached to a bottom of a carrier rail and extends parallel to the surface of the binder cover. It includes a straight portion extending upwards at an angle to the cover, for accomodating the paper. The second ring element is generally of conventional design. The Krause KG British patent is generally similar, but the ring element with the angled straight section is attached to the top of its carrier rail. Weichert also provides grooves in the cardboard stiffener of the binder cover, to accomodate the ring elements. This causes pressure from the horizontal leg of the ring elements to stress and distort the fabric or material covering the stiffener of the binder cover, which can tear or otherwise damage it. The effect is worse when the rings are opened. Both these patents suffer from the disadvantage that one ring element of each ring pair is of known conventional design. This effectively limits the overall capacity of the mechanism. The capacity of the conventional ring element is less than the capacity of the novel element, so that the greater capacity of the novel element cannot in practice be used. Also, the curved conventional ring element is prone to paper becoming wedged or jammed below its mid-point. As discussed above, this creates particular difficulties, when it is desired to close the binder. If the paper is not moved about in separate small batches, then it may be damaged.

U.S. Pat. No. 3,809,485 (Beyer) discloses a loose-leaf binder construction including a plastic backbone or spine with intregal studs for securing a ring mechanism. Here again, conventional curved ring elements are shown, and the construction and mode of operation of these is not discussed.

Finally, there is U.S. Pat. No. 4,214,839 (Sheehan et al) Here, a loose-leaf binder has an arcuate back panel, into which the ring mechanism is fitted. Consequently, the cover rail of the mechanism is below the cover panels of the binder, so that sheets on the ring elements will lie flat against the cover panels. Nevertheless, the sheets of paper will be some distance above the cover rail, and a considerable portion of the ring elements is wasted; this distance is far greater than the normal spacing of the paper sheets above the bottom of the cover rail. This patent also shows unusual forms of ring elements, which it is expected would provide a quite restrictive capacity. It should be borne in mind that, in practice, the capacity is the greatest thickness of paper that can be accomodated on each ring element in the open position, the smaller capacity of the two ring elements determine the effective overall capacity. This is because one must be able to move the entire contents from one ring element to the other.

The present invention is concerned with a ring binder mechanism that will provide a maximum capacity, for its overall dimensions. With this in mind, the capacity of each ring element should be the same. It should enable paper to be moved easily from a "reading side" to a "storage side", and vice versa. This movement should be achieved as smoothly as possible, particularly when closing the binder. It should be possible to flip all the materials from the storage side across to the reading side. The contents of the binder should lie as near the horizontal and the cover panels or members of the binder as possible. The paper should be as flat as possible.

According to the present invention, there is provided a ring mechanism for mounting on a loose-leaf binder having at least one generally planar cover member and including ring elements moveable between open and closed positions so that paper having ring holes spaced inwardly from an edge thereof can be retained on the ring elements in said binder, the mechanism comprising: a resilient cover rail having turned-in side edges and apertures at its said edges; a first carrier rail for carrying first ring elements; at least one first ring element, the or each of which is mounted at a first end thereof on the first carrier rail extending through a respective aperture in the cover rail, and includes a second end formed as a mesh end and a first, bottom portion extending from the first end thereof to a first intermediate location, which, in use in the closed position, is spaced further from a binder cover member than the first end thereof, the first bottom portion being arranged to receive and support paper below the top of the cover rail and adjacent a binder cover member; a second carrier rail for second ring elements, the first and second carrier rails being nested in side by side relationship between side edges of said cover rail, the combined width of the carrier rails being greater than the width between said side edges when said cover rail is unstressed, whereby the carrier rails may be moved between an over centre open position and an over centre closed position; at least one second ring element, the or each of which is mounted at a first end thereof on the second carrier rail extending through a respective aperture in the cover rail, and includes a second end formed as a mesh end adapted to mesh with the mesh end of a first ring element, and a second bottom portion extending from the first end thereof to a second intermediate location, which, in use in the closed position is spaced further from a binder cover member than the first end thereof, the second bottom portion being arranged to receive and support paper below the top of the cover rail and adjacent a binder cover member, with the first and second ring elements defining a closed loop with their mesh ends meshing with one another when said carrier rails are in said closed over centre position, and said mesh ends of the first and second ring elements being spaced from one another when said carrier rails are in the open over centre position; and mounting means for mounting the cover rail to a binder cover member so that the first ends of the ring elements are spaced above the cover member, whereby clearance for movement of the ring elements between open and closed positions is provided by the spacing of said first ends from the cover member and by the greater spacing of said intermediate locations from the cover member in the closed position, as compared to the first ends of the ring elements.

Preferably, the cover rail is arranged to be spaced from a cover member of binder by means of a bushed rivet.

The two ring elements can either be the same, or different. They can both include straight bottom portions, which are inclined at a slight angle in the closed position, so as to provide the required spacing for the intermediate locations, to facilitate opening.

In one embodiment of the present invention, one ring element has a straight inclined portion extending upwards from the cover member, and an inclined bottom portion to provide the spacing for the intermediate location. The other ring element is continuously curved from the carrier rail up to its mesh end. Consequently here the intermediate location does not define a junction between two distinct portions of the ring element. However, the ring element is still so formed as to facilitate opening of the ring elements.

The mechanism of the present invention can enable paper stored on it to lie flat. By providing bottom portions extending out from the sides of the cover rail, the paper can be stored close to the horizontal against the cover members of the binder, and does not have to be spaced above them by the thickness of the cover rail, as in known designs. The provision of ring elements with similar bottom profiles enables the ring elements to have similar capacities, even if the upper forms of the ring elements are different. Thus, the ring elements can have relatively large capacities. Here, again, the fact that the paper is not spaced by the thickness of the cover rail enables the capacity of the ring elements to be increased. Unlike known designs, neither of the ring elements need have a semi-circular profile, which tends to cause paper to become trapped at the bottom. The invention can provide ring elements which permit ready and smooth movement of paper from one side to the other.

For a better understanding of the present invention, and to show more clearly how it may be carried into effect, reference will now be made, by way of example, to the accompanying drawings, which show preferred embodiments of the present invention, and in which.

Figure 1:
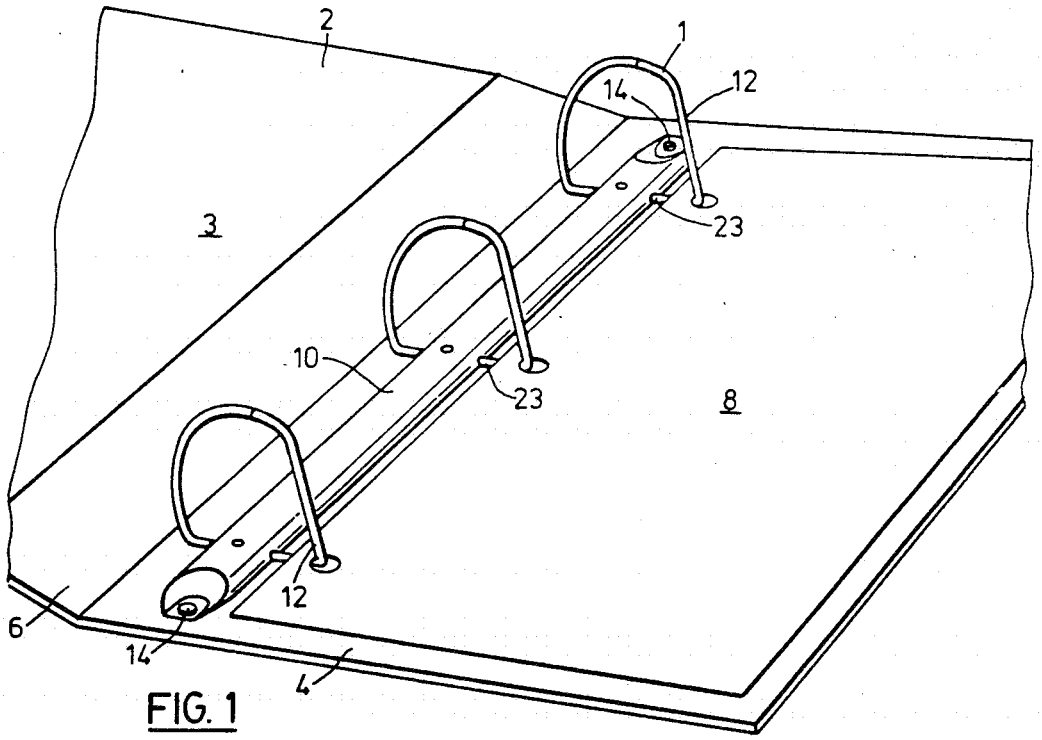
FIG. 1 is a perspective view of a ring mechanism mounted on a binder.

In FIGS. 1–5, a first embodiment of the ring system is generally denoted by the reference 1, and is mounted on a binder 2. The binder 2 includes front and back cover members or sheets 3,4 and a spine 6, connected by fabric hinges to the cover members 4. The ring mechanism 1 is mounted on the rear cover member 4, as shown in FIG.

1. The method of mounting is described in greater detail below.

In known manner, the ring mechanism 1 includes a cover rail 10 and ring sets 12. As shown in FIG. 1, sheets of paper 8 are located on the ring sets 12. The cover rail 10 is provided with openings for rivets 14, for securing it to the rear cover member 4, and this fastening is described in greater detail below.

Figure 2:
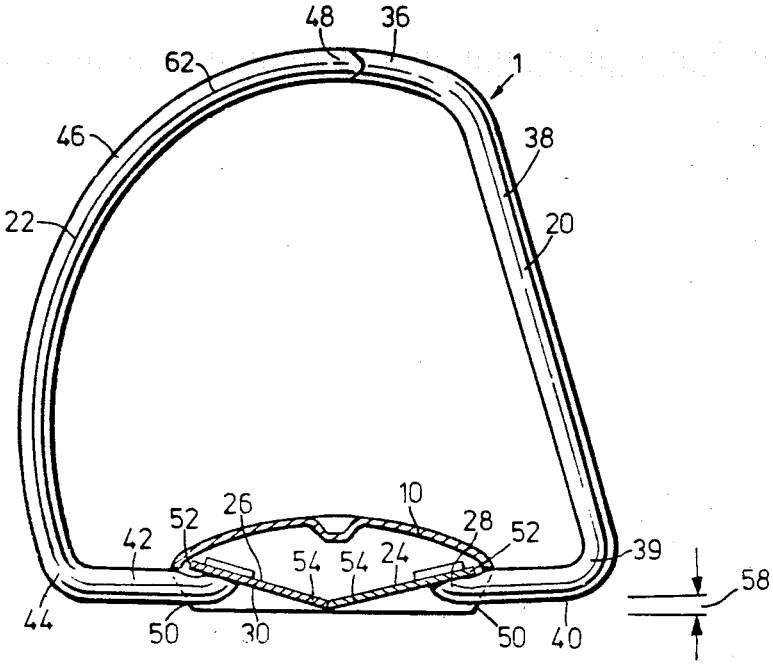
FIG. 2 is a sectional view of the ring mechanism of FIG. 1 along the line 2—2, showing the mechanism in a closed position.
Figure 3:
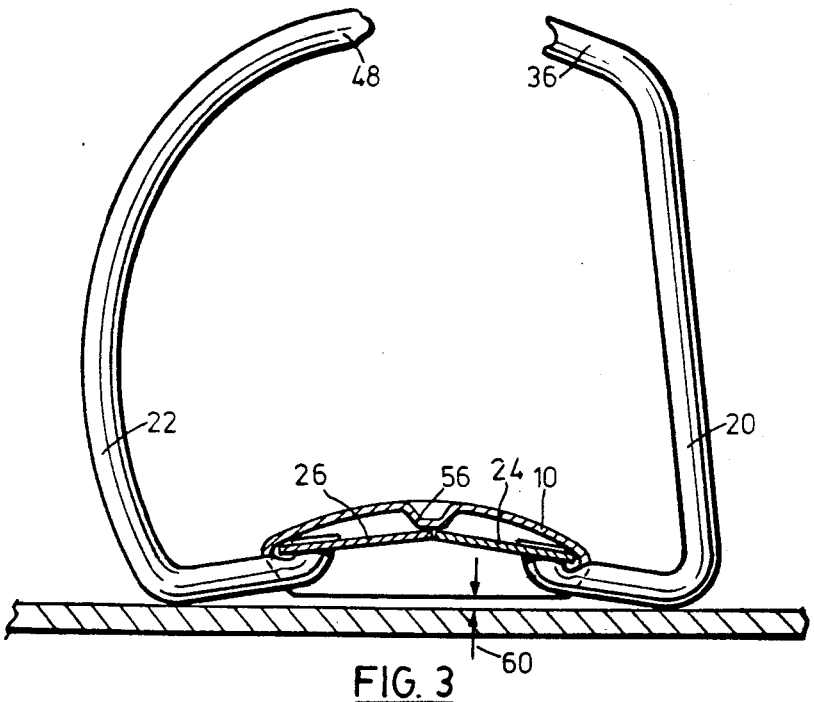
FIG. 3 is a sectional view similar to FIG. 2 illustrating the mechanism in an open position.

With reference to FIGS. 2 and 3, each ring set 12 consists of a first ring element 20 and a second ring element 22. Here, the first ring element 20 is secured or carried on a first carrier rail 24, and the second ring element 22 is similarly secured to a second carrier rail 26. The first and second ring elements 20, 22 pass through respective apertures 23 in the cover rail 10. Both of the first and second ring elements 20, 22 are secured to the bottom of their respective carrier rails 24 26, at the edges thereof. A first end 28 of the first ring element 20 is flattened against the bottom of its carrier rail 24, and a first end 30 of the second ring element 32 is similarly flattened against the second carrier rail 26. This flattening of the ends 28, 30 serves to secure the ring elements 20, 22 in position in a similar manner to a rivet. As an alternative, the ends 28, 30 could be welded to their respective carrier rails 24, 26.

As shown, the first ring elements 20 includes a second, mesh end 36. Extending from the mesh end 36 is a generally straight portion 38 extending outwardly and downwardly towards the plane of the cover member 4. A second generally straight, but shorter, portion 40 extends from the lower end of the straight portion 38 to the first end 28. In the closed configuration shown in FIG. 2, the straight portion 40 is at a slight angle to the cover member 4. An intermediate location 39 is formed at the junction between the straight portions 38, 40. As the straight portion 40 is at an angle, this intermediate location is higher than the first end 28, and spaced further from the cover member 4.

The second ring element 22 also includes a bottom portion 42, similar to the portion 40, which is straight and extends at a slight angle to the cover member 4. So, a second, intermediate location 44 is higher than the first end 30. The intermediate location 44 is at a junction between the straight portion 42 and an arcuate portion 46. The arcuate portion 46 extends upwards through approximately a right angle to a second, mesh end 48. The mesh ends 36, 48 are adapted to mesh with one another and have complementary profiles.

The cover rail 10 is provided with inwardly turned edges 50 for retaining the first and second carrier rails 24, 26. Outer edges 52 of the first and second carrier rails 24, 26 abut or lie against the inwardly turned edges 50. Inner edges 54 of the first and second carrier rails 24, 26 lie against or abut one another. The carrier rails 24 and 26 are additionally provided with tabs that overlap one another, to prevent relative displacement between the edges 54 and to maintain these edges 54 in contact with one another. The cover rail 10 is formed from a resilient material and, in an unstressed condition, such as shown in FIGS. 2 and 3, the combined width of the first and second carrier rails 24, 26 is greater than the maximum distance between the inwardly turned edges 50. This effectively defines overcenter positions for the carrier rails 24, 26.

In FIG. 2, the carrier rails 24, 26 are shown in a closed overcenter position. In this position, the edges 54 of the carrier rail 24, 26 are adjacent the bottom of the cover rail 10 and the ring elements 20, 22 mesh at their ends 36, 48, to form a complete ring. In FIG. 3, the carrier rail 24, 26 have been moved to an open overcenter position in which the edges 54 of the carrier rails 24, 26 are at the top of the cover rail 10, and the mesh ends 36, 48 are disengaged to open the ring elements 20, 22. As shown in FIG. 3, the cover rail 10 can be provided with a dimple or projection 56, serving to limit the position of the carrier rails 24, 26 in the open position, and thus effectively limit the opening of the ring elements 20, 22.

The provision of straight horizontal portions for both ring elements 20, 22 could result in the ring elements 20, 22 fouling the cover member 4 when opened. To accomodate the ring elements 20, 22 in the open position shown in FIG. 3, the bottom portions 40, 42 are inclined at a small angle in the closed position as indicated by the reference 58 in FIG. 2. Also, the cover rail 10 is mounted so as to be spaced above the cover rail 4 by a small amount, as indicated at 60 in FIG. 3. These two features ensure that the corners of the elements 20, 22 at the intermediate locations 39, 44 are given adequate clearance. In the closed position shown in FIG. 2, the intermediate location 39, 44 are spaced slightly above the cover member 4. When the ring elements 20, 22 are open, as shown in FIG. 3, they will just contact the cover member 4 at their bottom corners or intermediate locations 39, 44. In this regard, the cover member 4 is usually formed from fabric covered cardboard, and this has a natural resilience that will help accomodate the ring elements 20, 22 when opened.

For a typical ring mechanism, the length of the bottom leg or portion 40 or 42 should be in the range 9–11 mm, and in the closed position its angle to the horizontal, indicated at 58, should be in the range 5°–8°. In addition, the spacing indicated at 60 for the cover rail 10 is in the range 1–2 mm. It has been found that these dimensions provide adequate clearance for the rings 20, 22 when opened.

In use, loose leaf paper 8 is stored or retained on the ring sets 12, as shown in FIG. 1. When it is desired to add additional sheets or remove sheets already present, the ring elements 20, 22 are simply moved manually from the closed position to the open position against the spring action provided by the cover rail 10 and carrier rails 24, 26. In the open position shown in FIG. 3, the ring elements 20, 22 at the intermediate locations 39, 44 will be close to or abutting the cover member 4. In the open position, paper can be placed on or taken off one or both of the ring elements 20, 22 as desired.

The configuration of the ring elements 20, 22 has a number of advantages over known configurations. As both ring elements 20, 22 include straight horizontal portions 40, 42, paper retained on them will be close to the cover members 4. The actual edges of sheets of paper 8 on the ring elements 20, 22 will only be lifted up slightly from the cover member 4. This also provides a large capacity for the ring element 20, 22. For the right-hand ring element 20, paper sheets 8 can be stacked from the top of the bottom leg or portion 40 all the way up to the top of the straight portion 38. This should be contrasted with known designs, where paper has to rest on top of the cover rail 10, and consequently the depth of the cover rail 10 reduces the effective storage capacity. Here, the left-hand ring element 22, as viewed in FIG. 2, is also arranged to provide a large capacity. Again, paper sheets 8 can be stacked on top of its bottom portion 42 all the way up to a location indicated at 62, this giving a capacity equivalent to that for the other ring element 20. The provision of ring elements of equal capacity is important. In practice, the ring element with the smallest capacity effectively limits the overall capacity of the whole mechanism, as one needs to be able to move all the contents from one side to the other. This is necessary, in order to read both sides of every sheet and in order to remove and replace individual sheets. Thus, the ring profiles 20, 22 provide a maximum capacity for the mechanism, relative to the overall dimensions of the mechanism.

Another important consideration is the means with which paper can be removed from one ring element 20 to the other ring element 22. Here again, the provision of straight bottom portions 40, 42 assists. The paper sheets are located on the ring elements 20, 22 on their portions 38 and 46. The portion 38 is directed upwards and towards the ring elements 22, and the portion 46 is similarly directed upwards and for most of its length towards the ring element 20. Thus, neither portion 38, 46 includes an outwardly curved lower section, below which paper can be trapped or wedged. With the ring profiles shown, it is quite an easy and simple matter to grasp even quite large batches of paper and move them from one ring element to the other.

As shown, the mechanism is intended to be mounted on the rear cover member 4 of the binder, and this provieds better support for the paper. Also, the mechanism shown is intended to be operated by gripping the ring elements of the ring sets 12. The ring elements are then manually moved between the open and closed overcenter positions. As an alternative, in known manner, the mechanism can include triggers or boosters to enable the ring sets to be opened and closed. The triggers are mounted at ends of the cover rail 10 and act on the carrier rails 24, 26. Movement of the triggers in a direction towards each other closes the ring sets, whilst movement of the triggers away from one another opens the ring sets. Such a mechanism, which is not concerned with the profile of the ring elements 20, 22, could be included in the ring mechanism of the present invention.

Figure 4:
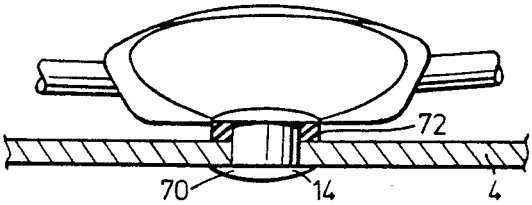
FIG. 4 is an end view of one end of the mechanism showing a rivet for mounting it to the cover member.
Figure 5:
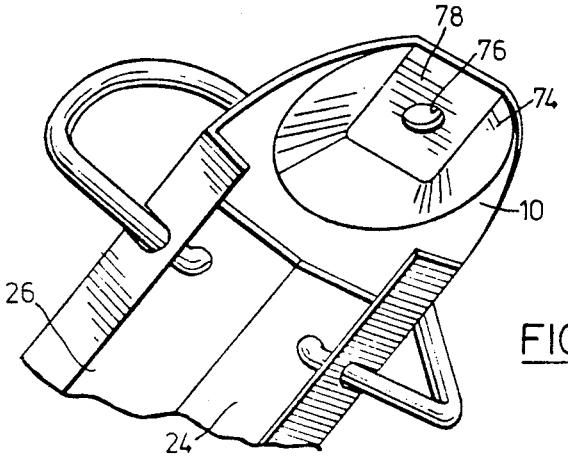
FIG. 5 is a perspective view from below illustrating one end of the mechanism.

FIGS. 4 and 5 show details of the mounting of the cover rail 10. As shown in FIG. 4, the rivet 14 is a bushed rivet comprising a main rivet body 70 and a bushing 72. The provision of bushing 72 at either end of the cover rail 10 serve to space it above the rear cover member 4 by the desired amount 60. Additionally, the bushings 72 and rivets 70 can serve to permit a small amount of angular movement of the whole mechanism relative to the cover member 4, about a longitudinal axis of the mechanism. FIG. 5 shows a perspective view from underneath of one end of the cover rail 10. As shown, the end of the cover rail 10 includes a flattened portion 74 including an opening 76 for the rivet 14. If desired, a flat area 78 of the portion 74 can be spaced downwards from the main body of the cover rail 10,to effectively space the main body of the cover rail above the cover member 4. This could be used instead of, or in conjunction with, bushings 72.

Figure 6:
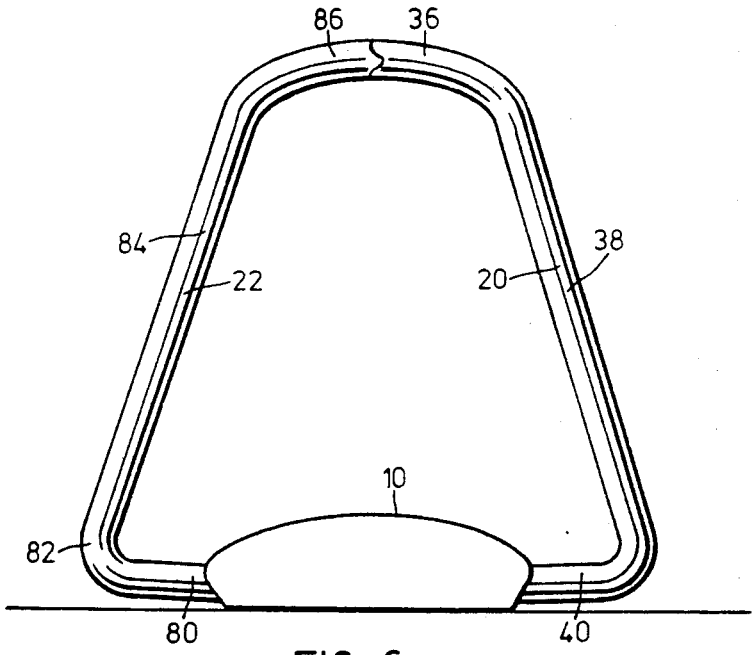
FIG. 6 is a sectional view similar to FIG. 2 of a second embodiment of the mechanism.
Figure 7:
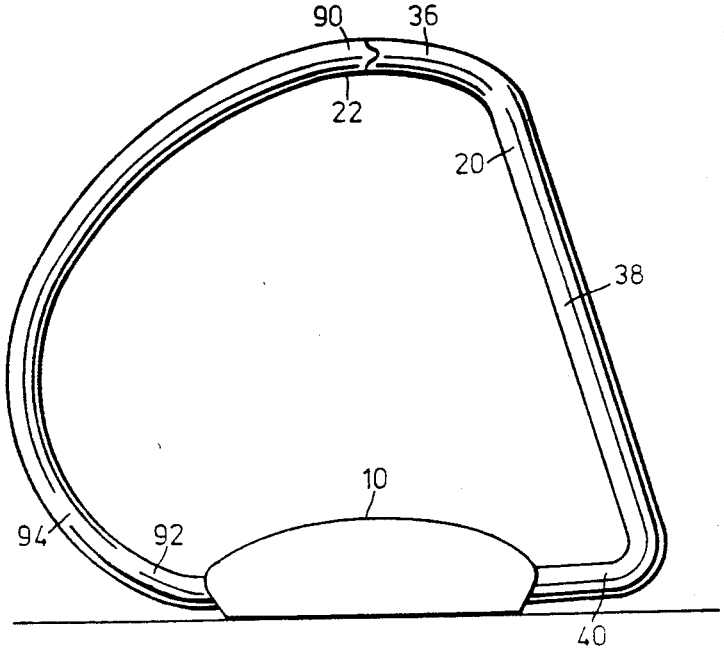
FIG. 7 is a sectional view similar to FIG. 2 of a third embodiment of the mechanism.

Reference will now be made to FIGS. 6 and 7 which show alternative forms for the ring elements. In these figures, the ring elements are again denoted by the reference 20, 22, and parts of the ring elements which are the same as in the earlier figures are denoted by the same reference numerals. Details of the mechanism within the cover rail 10 is not shown, as it is the same as in FIGS. 1–5.

In FIG. 6, the right-hand ring element 20, as shown, is the same as the element 20 of FIG. 2. The other ring element 22 now has a profile similar to the ring element 20; thus, the ring element 20, 22 are symmetrical about a vertical plane, except for differences in the mesh ends. The ring element 22 comprises a straight bottom portion 80, which is inclined to the cover member 4. The straight bottom portion 80 joins a straight portion 84 extending upwards at an angle to the cover member 4, at an intermediate location 82. The ring element 22 has a mesh end 86 extending from the front of the straight portion 84. The overall ring profile provided by the two ring elements 20, 22 in this embodiment is generally trapezoidal. As the ring elements 20, 22 are symmetrical, they can store the same amount of paper. Again, as in the previous embodiment, the provision of straight portions 40, 80 for base ring elements 20, 22 provides a large capacity for the ring mechanism, whilst keeping its overall height low. Providing both ring elements 20, 22 with straight side portions 38, 84 is particularly suited to binders enclosing reference material provided with projecting index tabs, as all the index tabs should be readily visible, irrespective of how much paper is on each ring element 20, 22.

FIG. 7 shows a third embodiment of the invention, in which the ring element 20 again has the same profile as in the first two embodiments. Here, the second ring element 22 has a different profile. The elements 22 is generally arcuate or curved. Thus, the element 22 extends in an almost continuous curve from its first end within the cover rail 10 to its second, mesh end 90. A bottom portion 92 of the arcuate or curved ring element 22 is still such as to provide good, uniform support for the paper sheets. A lower most section of the ring element 22, which actually engages paper sheets is denoted by the reference 94, and is preferably relatively short and comparatively flat, to enable sheets of paper on it to be moved quite freely when the binder is closed. The provision of a rounded ring element 22 also enables the whole mechanism to be mounted slightly lower. When the mechanism is opened, the ring element 22 will effectively "roll" on the cover 4, and clearance does not have to be provided for it. In fact, the whole mechanism can be arranged to rotate slightly counterclockwise, as viewed in FIG. 7, to accomodate the downward displacement of the corner or intermediate location 39, when the mechanism is open.

Figure 8:
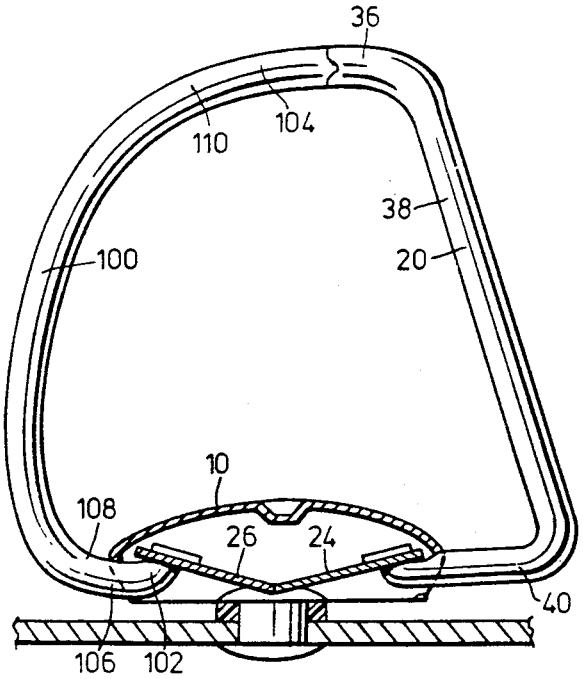
FIG. 8 shows a sectional view similar to FIG. 2 of a fourth embodiment of the mechanism.

Reference will now be made to FIG. 8 which shows another embodiment of the present invention. Here, the ring element 20 is the same as that described in the earlier embodiments. The left-hand ring element is designated by the reference 100 and has a profile which is, in effect, a cross between the first embodiment shown in FIG. 2 and the third embodiment shown in FIG. 7. The ring element 100 has a bottom portion 106, which is only slightly curved and serves, in use, to support paper. A first end 102 of the element 100 is secured to a carrier rail 26. An upper portion 110 of the element 100 has generally the shape of a quadrant, and is connected to the bottom portion 106 by a corner portion 108.

The corner portion 108 blends smoothly into the two other portions 106, 110. Like the third embodiment, the rounded profile provided by the portions 106, 108 provides additional clearance on the left-hand side. Consequently, as before the mechanism can rock slightly counterclockwise, when it is opened. This enables it to be mounted lower.

I claim:

1. A ring mechanism for mounting on a loose leaf binder having at least one generally planar cover member and including ring elements moveable between open and closed positions so that paper having ring holes spaced inwardly from an edge thereof can be retained on the ring elements in said binder, the mechanism comprising: a resilient cover rail having turned in side edges and apertures at its said edges; a first carrier rail, for carrying first ring elements; at least one first ring element, the or each of which is mounted at a first end thereof on the first carrier rail extending through a respective aperture in the cover rail, and includes a second end formed as a mesh end and a first, bottom portion extending from the first end thereof to a first intermediate location, which, in use in the closed position, is spaced further from a binder cover member than the first end thereof, the first bottom portion being arranged to receive and support paper below the top of the cover rail and adjacent a binder cover member; a second carrier rail for second ring elements, the first and second carrier rails being nested in side by side relationship between side edges of said cover rail, the combined width of the carrier rails being greater than the width between said side edges when said cover rail is unstressed, whereby the carrier rails may be moved between an over centre open position and an over centre closed position; at least one second ring element, the or each of which is mounted at a first end thereof on the second carrier rail extending through a respective aperture in the cover rail and and includes a second end formed as a mesh end adapted to mesh with the mesh end of a first ring element, a second bottom portion extending from the first end thereof to a second intermediate location, which, in use in the closed position is spaced further from a binder cover member than the first end thereof, the second bottom portion being arranged to receive and support paper below the top of the cover rail adjacent a binder cover member, with the first and second ring elements defining a closed loop with their mesh ends meshing with one another when said carrier rails are in said closed over centre position, and said mesh ends of the first and second ring elements being spaced from one another when said carrier rails are in the open over centre position; and mounting means for mounting the cover rail to a binder cover member so that the first ends of the ring elements are spaced above the cover member, whereby clearance for movement of the ring elements between open and closed positions is provided by the spacing of said first ends from the cover member and by the greater spacing of said intermediate locations from the cover member in the closed position, as compared to the first ends of the ring elements.

2. A ring mechanism as claimed in claim 1, wherein the first ring element includes a first elongate straight portion extending between the first bottom portion and the first mesh end, and arranged so that, in use in the closed position, the first elongate straight portion is at an angle to a binder cover.

3. A ring mechanism as claimed in claim 1 or 2, wherein the second ring element comprises a first bottom portion, which is slightly curved and which extends from the first end, an upper curved portion extending through approximately a right angle from the second, mesh end, and a corner portion extending between, and blending smoothly into, the first, bottom portion, and the upper, curved portion.

4. A ring mechanism as claimed in claim 1, wherein the second ring element includes a second elongate straight portion, which extends between the second bottom portion and the second mesh end, and which, in use in the closed position, extends at an angle to a binder cover member.

5. A ring mechanism as claimed in claim 4, wherein the first ring element includes a straight, elongate portion, which extends between the first bottom portion and the first mesh end and, in use in the closed position, is at an angle to a binder cover member, and wherein both of the first and second bottom portions are straight, and each of the first and second bottom portions, in use in the closed position, is at an angle to a binder cover member.

6. A ring mechanism as claimed in claim 5, wherein both the first and second bottom portions are of the same length, and wherein the first and second ring elements are symmetrical about a longitudinal plane, and together form a trapezoidal ring.

7. A ring mechanism as claimed in claim 1, 2 or 4, wherein the first and second bottom portions of the first and second ring elements extend underneath their respective first and second carrier rails.

8. A ring mechanism as claimed in claim 1, 2 or 4, wherein the mounting means comprises openings in the cover rail for receiving rivets, rivets for mounting the cover rail to a binder cover member, and bushings for spacing the cover rail from a binder cover member.

9. A ring mechanism as claimed in claim 1, 2 or 4, wherein the mounting means includes a central opening in a top portion of the cover rail, a rivet for securing the cover rail by the central opening to a binder cover member, and an elongate bushing for extending through the cover rail to the top thereof, to space the cover rail from a binder cover member.

10. A ring mechanism as claimed in claim 1, 2 or 4, wherein the mounting means comprises openings in the cover rail, for rivets, rivets for mounting the cover rail to a binder cover member, and bushing means for spacing the cover rail from a binder cover member, the rivets and bushings and the spacing of the openings in the cover rail being such as to permit a small amount of angular movement of the cover rail about a longitudinal axis thereof.

11. A ring mechanism as claimed in claim 1, wherein the second elongate element includes a curved portion extending between the second bottom portion and the second mesh end, the curved portion comprising approximately a quarter of a circle.

12. A ring mechanism as claimed in claim 2, 4 or 11, wherein the first bottom portion is straight and, in use in the closed position, is at an angle to a binder cover member.

13. A ring mechanism as claimed in claim 2, 4 or 11, wherein the second bottom portion is straight and, in use in the closed position, is at an angle to a binder cover member.

14. A ring mechanism as claimed in claim 2, 4 or 11, wherein both the first and second bottom portions are straight and, each of the first and second bottom portions, in use in the closed position, is at an angle to a binder cover member.

15. A ring mechanism as claimed in claim 2, 4 or 11, wherein both of the first and second bottom portions are straight and in use in the closed position, is at an angle to a binder cover member with the first and second intermediate locations the same height above the binder cover member.

16. A ring mechanism as claimed in claim 11, wherein the first ring element includes a straight, elongate portion, which extends between the first bottom portion and the first mesh end and which in use in the closed position, is at an angle to a binder cover member, and wherein both of the first and second bottom portions are straight, and each of the first and second bottom portions, in use in the closed position, is at an angle to a binder cover member.

17. A ring mechanism as claimed in claim 5 or 16, wherein the first and second bottom portions have the same length.

18. A ring mechanism as claimed in claim 5, 16, or 6, wherein the first and second bottom portions of the first and second ring elements extend underneath their respective first and second carrier rails.

19. A ring mechanism as claimed in claim 1, wherein the second ring element has a curved profile, including a curved central portion which merges smoothly with the bottom portion and the second mesh end, the first and second ends of the second ring element being approximately parallel with one another.

20. A ring mechanism as claimed in claim 19, wherein the second ring element has a relatively small radius of curvature at the bottom, and a relatively large radius of curvature at the top

21. A ring mechanism as claimed in claim 19 or 20, wherein the first bottom portion is straight and, in use in the closed position, is at an angle to a binder cover member.

22. A ring mechanism as claimed in claim 19 or 20, wherein the second intermediate location, in use, is spaced further from a cover member than the first intermediate location.

23. A ring mechanism as claimed in claim 11, 19 or 20, wherein the first and second bottom portions of the first and second ring elements extend underneath their respective first and second carrier rails.

24. A ring mechanism as claimed in claim 11, 19 or 20, wherein the mounting means comprises openings in the cover rail for rivets, for mounting the cover rail to a binder cover member, and bushings for spacing the cover rail from a binder cover member.

25. A ring mechanism as claimed in claim 11, 19 or 20, wherein the mounting means includes a central opening in a top portion of the cover rail, a rivet for securing the cover rail via the central opening to a binder cover member, and an elongate bushing for extending to the top portion of the cover rail for spacing the cover rail from a binder cover member.

26. A ring mechanism as claimed in claim 4, 11 or 19, wherein the first ring element includes a straight elongate portion, which extends between the first bottom portion and the first mesh end, and which, in use in the closed position, extends at an angle to a cover member.

* * * * *